US008899731B2

(12) United States Patent
Reinten et al.

(10) Patent No.: US 8,899,731 B2
(45) Date of Patent: Dec. 2, 2014

(54) INKJET PRINT HEAD HAVING TWO ACTUATOR MEMBRANES

(71) Applicant: OCE-Technologies B.V., Venlo (NL)

(72) Inventors: Hans Reinten, Velden (NL); Marcus J. Van Den Berg, Venlo (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 14/100,948

(22) Filed: Dec. 9, 2013

(65) Prior Publication Data

US 2014/0098163 A1 Apr. 10, 2014

Related U.S. Application Data

(63) Continuation of application No. PCT/EP2012/061934, filed on Jun. 21, 2012.

(30) Foreign Application Priority Data

Jun. 24, 2011 (EP) ..... 11171287

(51) Int. Cl.
*B41J 2/045* (2006.01)
*B41J 2/14* (2006.01)

(52) U.S. Cl.
CPC ..... *B41J 2/14274* (2013.01); *B41J 2/14233* (2013.01); *B41J 2002/14338* (2013.01)
USPC ..... 347/70; 347/48; 347/47

(58) Field of Classification Search
CPC ..... B41J 2/04533; B41J 2/14032; B41J 2/14056; B41J 2/14064; B41J 2/14272; B41J 2/14282
USPC ..... 347/20, 44, 47, 48, 56, 68, 70–71
See application file for complete search history.

(56) References Cited

U.S. PATENT DOCUMENTS

| | | | | |
|---|---|---|---|---|
| 4,672,398 | A * | 6/1987 | Kuwabara et al. | 347/48 |
| 2011/0007117 | A1 | 1/2011 | Bibl et al. | |
| 2011/0074845 | A1 | 3/2011 | Kitakami et al. | |

FOREIGN PATENT DOCUMENTS

| | | | |
|---|---|---|---|
| JP | 61-114854 | A | 6/1986 |
| JP | 7-251504 | A | 10/1995 |
| JP | 8-52873 | A | 2/1996 |
| JP | 11-170524 | A | 6/1999 |

* cited by examiner

*Primary Examiner* — Juanita D Jackson
(74) *Attorney, Agent, or Firm* — Birch, Stewart, Kolasch & Birch, LLP

(57) ABSTRACT

An ink jet printing device includes a pressure chamber, a first actuator membrane being arranged to form a first flexible wall of the pressure chamber, a first piezo-electric part being operatively connected to a surface of the first actuator membrane, a second actuator membrane being arranged to form a second flexible wall of the pressure chamber and a second piezo-electric part being operatively connected to a surface of the second actuator membrane, wherein the second flexible wall is mechanically decoupled from the first flexible wall.

20 Claims, 10 Drawing Sheets

INKJET PRINT HEAD HAVING TWO ACTUATOR MEMBRANES

CROSS REFERENCE TO RELATED APPLICATIONS

This application is a Continuation of PCT International Application No. PCT/EP2012/061934 filed on Jun. 21, 2012, which claims priority under 35 U.S.C 119(a) to Application No. 11171287.3 filed in the European Patent Office on Jun. 24, 2011 all of which are hereby expressly incorporated by reference into the present application.

FIELD OF THE INVENTION

The present invention relates to an ink jet printing device, comprising a pressure chamber, an actuator membrane arranged to form a flexible wall of the pressure chamber, and a piezo-electric part operatively connected to the actuator membrane.

BACKGROUND ART

MEMS based inkjet print heads using a bimorph actuator comprising a silicon actuator membrane and a thin film piezo (TFP) are known in the art. For actuator performance and robustness (life-time) a low driving voltage may be crucial. Low voltage operation implies that an actuator should be able to deliver a large volume displacement per Volt [pl/V] at a given actuator compliance [pl/bar], the latter being determined by the desired acoustic design of the print head. For low voltage operation two factors are important:

1) The coupling efficiency, i.e. the required electrical energy to obtain a certain mechanical bimorph operation of the actuator membrane. The coupling efficiency may be expressed in terms of the above described volume displacement per Volt [pl/V] and the compliance of the actuator membrane [pl/bar]. The coupling efficiency is related to the thickness ratio of the thin film piezo and the actuator membrane. Optimum values of this thickness ratio depend on the basic material properties of the TFP and the actuator membrane and is approximately 1 for PZT piezo material which is a ceramic material comprising lead (Pb), zirconate (Zr) and titanate (Ti), e.g. in the following composition: $Pb[Zr_xTi_{1-x}]O_3$, wherein $0<x<1$ and a silicon actuator membrane;
2) Electric capacitance of the piezo, representing the amount of electrical energy that can be stored in the TFP for a given electric potential difference (voltage). The electric capacitance is proportional to the ratio of TFP surface area and TFP thickness.

For low voltage operation both factors should be large, which implies the use of a large area of TFP (thus having a large electric capacitance) on an actuator membrane, wherein the thickness ratio of the TFP and the actuator membrane is optimized in order to maximize the coupling efficiency. In the case of a silicon actuator membrane and PZT TPF, the actuator membrane and the TFP substantially have the same thickness.

A disadvantage of a large area thin actuator membrane is that such actuator membranes are often too compliant for a proper operation of the ink jet printing device, leading to all kinds of artifacts which may negatively influence the print quality.

Another disadvantage of such an actuator membrane is that the miniaturization of ink jet printing devices shows some unwanted restrictions (e.g. restricted maximum single pass resolution).

The compliance of the actuator membrane may be decreased by increasing the aspect ratio of the actuator membrane, i.e. increasing the membrane length, while maintaining the required surface area of the actuator membrane. In other words: the surface area of thin membranes may be increased together with increasing the aspect ratio of the actuator membrane in order to maintain a required compliance of the actuator membrane.

Following the above design strategy may lead to actuator membranes having a relatively large length, thus also requiring long pressure chambers.

Longer pressure chambers, may have a marked influence on the acoustics inside the pressure chamber (also referred to as ink channel): by actuation, an acoustic pressure response and a corresponding flow profile may be generated in a liquid present in the pressure chamber, e.g. an ink composition, enabling the liquid to be jetted out of a nozzle arranged in fluid connection with the pressure chamber. The pressure response and flow profile may depend on the properties of the liquid, such as its density and viscosity, and other dimensions of the liquid containing parts of the print head such as the depth of the pressure chamber.

In general the acoustic properties (e.g. resonance frequencies) inside the pressure chamber may be determined to a large extent by the combined (i.e. sum) compliances of the ink volume present in the pressure chamber and of the actuator membrane, i.e. the total compliance. To a certain extent, the above mentioned compliances may be interchangeable, for example if the compliancy of the ink volume is reduced (by changing the composition of the ink and/or the geometry of the pressure chamber), the compliancy of the actuator membrane(s) may be increased to the same extent, such that the total compliance and hence the acoustic properties inside the pressure chamber remain the same.

It is a disadvantage of the configuration as described above (i.e. relatively long actuator membranes positioned on relatively long pressure chambers), that the efficiency of generating the required pressure response and flow profile may decrease, e.g. due to an increased liquid volume, such that efficient operation of the ink jet printing device is not possible.

It is therefore an object of the present invention to provide an ink jet printing device that solves or at least mitigates the above stated disadvantages, the ink jet printing device thus having a robust and durable design, which may be operated at a low driving voltage, in particular below 30 V, without compromising the effective operation of the printing device and the resulting print quality.

SUMMARY OF THE INVENTION

This object may be achieved by providing an ink jet printing device, comprising:

- a pressure chamber;
- a first actuator membrane having a first membrane width $W_{m,1}$ and a first membrane length $L_{m,1}$, the first membrane width being equal to or smaller than the first membrane length, the first actuator membrane is arranged to form a first flexible wall of the pressure chamber;
- a first piezo-electric part being operatively connected to a surface of the first actuator membrane;
- a second actuator membrane having a second membrane width $W_{m,2}$ and a second membrane length $L_{m,2}$, the second membrane width being equal to or smaller than the second membrane length, the second actuator membrane is arranged to form a second flexible wall of the pressure chamber;

a second piezo-electric part being operatively connected to a surface of the second actuator membrane;

wherein the second flexible wall is mechanically decoupled from the first flexible wall.

Using multiple actuator membranes per pressure chamber, allows the use of a large area of thin actuator membranes, while maintaining the desired compliance of the actuator membranes and without requiring long actuator membranes and consequently long pressure chambers. Therefore, this configuration enables low voltage operation of the actuators without suffering from disturbed acoustics (e.g. run-time effects) inside the pressure chamber.

The first and the second actuator membranes according to the present invention are individually clamped, which means that the first actuator membrane and the second actuator membrane form separate and flexible walls of the pressure chamber, which are mechanically decoupled. Both actuator membranes may therefore be separately actuated.

In an embodiment, the first flexible wall and the second flexible wall are comprised in a single wall of the pressure chamber, in other words, the actuator membranes are arranged in the same plane such that the first actuator membrane forms a first flexible part of said single wall of the pressure chamber and the second actuator membrane forms a second flexible part of said single wall of the pressure chamber. The first and the second piezo-electric parts may be arranged such that they are operatively connected to the surfaces of the respective actuator membranes.

This embodiment has the advantage of reduced geometrical complexity and hence to a less complex manufacturing method. The first actuator membrane and the second actuator membrane may be formed as integral parts, e.g. in a single wafer-size carrier plate. The first piezo-electric part and the second piezo-electric part may be applied in a single processing step.

The pressure chamber may have a chamber width $W_{PC}$ and a chamber length $L_{PC}$, the chamber width being equal to or smaller than the chamber length.

In an embodiment, the first actuator membrane may have a first aspect ratio, $AR_1=L_{m,1}/W_{m,1}$ and the second actuator membrane may have a second aspect ratio, $AR_2=L_{m,2}/W_{m,2}$, wherein $AR_1$ and/or $AR_2$ may be between 1 and 150, preferably between 1 and 20.

In an embodiment, the first actuator membrane and/or the second actuator membrane may have an aspect ratio, i.e. $AR_1$ and $AR_2$, respectively of between 1.5 and 15, more preferably between 2 and 10, even more preferably between 2.5 and 8.

In an embodiment, the first actuator membrane may have a first membrane thickness $t_{m,1}$, the first piezo-electric part may have a first piezo thickness $t_{p,1}$, the second actuator membrane may have a second membrane thickness $t_{m,2}$, the second piezo-electric part may have a second piezo thickness $t_{p,2}$, wherein $t_{p,1}/t_{m,1}$, and/or $t_{p,2}/t_{m,2}$ may be between 0.1 and 2, preferably between 0.3 and 1.7, more preferably between 0.5 and 1.5, even more preferably between 0.7 and 1.3. Both ratios may be the same or different. The optimal ratios of the piezo thicknesses and the membrane thicknesses may be determined by a desired coupling efficiency between electrical energy and energy related to mechanical bimorph operation and may depend on the basic material properties of the materials used. For PZT piezo-electric material and an actuator membrane made of silicon, the optimal thickness ratio may be approximately 1.

The piezo-electric parts comprise laminate of a bottom electrode, a layer of a piezo-electric material, and an upper electrode. The bottom electrode may be in contact with an actuator membrane and the upper electrode may form the free upper surface of the piezo-electric part. The electrodes are made of an electrically conductive material, for example a metal, in particular copper, silver, gold or a combination thereof. In the context of the present invention the thicknesses of the piezo-electric parts (i.e. $t_{p,1}$ and $t_{p,2}$) include the thicknesses of the electrodes being a part of the piezo-electric parts. The thickness ratios of the respective electrodes and the layer of piezo-electric material may be selected and/or optimized depending on the specific application.

In an embodiment, $t_{m,1}$ and/or $t_{m,2}$ may be between 0.1 μm and 10 μm, preferably between 0.5 μm and 5 μm, more preferably between 1 μm and 4 μm. $t_{m,1}$ and $t_{m,2}$ may thus be the same or different.

In an embodiment, $t_{p,1}$ and/or $t_{p,2}$ may be between 0.1 and 10 μm, preferably between 0.5 μm and 5 μm, more preferably between 1 μm and 4 μm. $t_{p,1}$ and $t_{p,2}$ may thus be the same or different.

In an embodiment, the above thickness requirements may be combined.

The compliance of the first actuator membrane and/or the second actuator membrane may be decreased by increasing their respective aspect ratios at constant membrane thicknesses, piezo thicknesses and total surface areas of the respective actuator membrane-piezo-electric parts combinations.

In an embodiment, the first actuator membrane and the second actuator membrane may be arranged in parallel in a direction of their respective lengths.

In an embodiment, the first and the second actuator membranes are arranged such that their respective lengths ($L_{m,1}$ and $L_{m,2}$, respectively) are in parallel with the length of the pressure chamber, $L_{PC}$.

In an embodiment, the first and the second actuator membranes are arranged adjacent to each other in the width direction of the pressure chamber.

An advantage of using this arrangement of the actuator membranes is that low voltage operation of the actuator membranes may be possible without suffering from disturbed acoustics (e.g. run-time effects) inside the pressure chamber caused by a relatively long actuator membrane arranged on a relatively long ink channel. In fact this arrangement may be considered as cutting a long actuator membrane arranged in the length direction of the pressure chamber into two or more shorter parts and arranging the two or more parts adjacent to each other in the width direction of the pressure chamber. The membrane surface area may thus be maintained as well as the membrane compliance. However, the effects of the acoustics that may negatively influence the efficiency of generating the required pressure response and flow profile (e.g. run-time effects in long channels) and hence negatively influence the efficient operation of the printing device may be reduced.

In an embodiment, the first actuator membrane may be arranged to form a first flexible wall of a first part of the pressure chamber, the second actuator membrane may be arranged to form a second flexible wall of a second part of the pressure chamber. The ink jet printing device may comprise an orifice, the orifice extending from the pressure chamber to an outer surface of the printing device. The orifice may be arranged at an interface between the first and the second part of the pressure chamber.

Preferably, the first part of the pressure chamber and the second part of the pressure chamber are substantially symmetrical and share the (nozzle) orifice at the interface of the first and the second parts of the pressure chamber. The shape of the internal volume of the first part of the pressure chamber may be the mirror image of the shape of the internal volume of the second part of the pressure chamber.

Preferably the first flexible wall and the second flexible wall are comprised in a single wall of the pressure chamber, in other words, the actuator membranes are arranged in the same plane such that the first actuator membrane forms a first flexible part of said single wall of the pressure chamber and the second actuator membrane forms a second flexible part of said single wall of the pressure chamber.

Preferably the first actuator membrane and the second actuator membrane may be arranged at substantially equal distances from the (nozzle) orifice.

It is an advantage of the present embodiment that the first actuator membrane may be arranged upstream the orifice and the second actuator membrane may be arranged downstream the orifice, such that low voltage operation of the actuator membranes may be possible without suffering from disturbed acoustics (e.g. run-time effects) inside the pressure chamber caused by a relatively long actuator membrane arranged on relatively long ink channels.

The term interface as used in the present embodiment, should be construed as an imaginary plane dividing the pressure chamber into the first and the second part, such that the first actuator membrane is arranged to form a first flexible wall of the first part of the pressure chamber and the second actuator membrane is arranged to form a second flexible wall of the second part of the pressure chamber. The first and the second parts of the pressure chamber are therefore not physically separated, i.e. the combined first and the second parts of the pressure chamber form one internal volume, substantially equal to the internal volume of the pressure chamber.

In an embodiment, the ink jet printing device may further comprise:

an inlet channel being in fluid connection with the first part of the pressure chamber and arranged to supply a fluid to the pressure chamber;

an outlet channel being in fluid connection with the second part of the pressure chamber and arranged to remove the fluid out of the pressure chamber.

This embodiment enables a flow-through arrangement: the liquid may flow through the pressure chamber, also when the particular pressure chamber is idle, i.e. when no droplets are jetted from the particular orifice. An advantage of this arrangement is that dead volumes in the pressure chamber are prevented or at least reduced, which is particularly advantageous when the orifice is arranged at the interface between the first and the second part of the pressure chamber. The reduction of dead volumes may reduce the risk of fouling of the pressure chamber by e.g. solid particulates that may adhere to the surfaces of the pressure chamber or coagulate to form larger particles that may cause clogging of the nozzles.

Thus, upon actuation a droplet may be generated while the fluid, e.g. an ink composition, may flow through the pressure chamber.

In an embodiment, the first actuator membrane has a first surface arranged to form an inside surface of the first flexible wall of the pressure chamber and a second surface arranged opposite to the first surface and forming an outside surface of the first flexible wall of the pressure chamber, the first piezo-electric part being arranged on the second surface of the first actuator membrane. The second actuator membrane has a third surface arranged to form an inside surface of the second flexible wall of the pressure chamber and a fourth surface arranged opposite to the first surface of the second actuator membrane and forming an outside surface of the second flexible wall of the pressure chamber, the second piezo-electric part being arranged on the fourth surface of the second actuator membrane.

This arrangement has the advantage that the first piezo-electric part and the second piezo-electric part do not come into contact with an ink composition present in the pressure chamber. This is particularly advantageous when ink-compositions comprise components that may be harmful to the piezo-electric material.

In an embodiment, the piezo-electric parts may be arranged with their respective length directions parallel to the length directions of the respective actuator membranes.

In an embodiment, the first piezo-electric part may have a first piezo width $W_{p,1}$ and a first piezo length $L_{p,1}$, the first piezo width being equal to or smaller than the first piezo length; the second piezo-electric part may have a second piezo width $W_{p,2}$ and a second piezo length $L_{p,2}$, the second piezo width being equal to or smaller than the second piezo length; wherein $L_{p,1}/L_{m,1}$ and/or $L_{p,2}/L_{m,2}$ may be between 0.7 and 1, preferably between 0.75 and 0.98, more preferably between 0.8 and 0.95, such that the first and the second actuator membranes have a length coverage with piezo-electric material of between 70% and 100%, preferably between 75% and 98%, more preferably between 80% and 95%.

In an embodiment, the first piezo-electric part may have a first piezo width $W_{p,1}$ and a first piezo length $L_{p,1}$, the first piezo width being equal to or smaller than the first piezo length; the second piezo-electric part may have a second piezo width $W_{p,2}$ and a second piezo length $L_{p,2}$, the second piezo width being equal to or smaller than the second piezo length; wherein $W_{p,1}/W_{m,1}$ and/or $W_{p,2}/W_{m,2}$ may be between 0.5 and 1, preferably between 0.6 and 0.98, more preferably between 0.7 and 0.95, such that the first and the second actuator membranes have a width coverage with piezo-electric material of between 50% and 100%, preferably between 60% and 98% %, more preferably between 70% and 95%.

In an embodiment, the requirements regarding the length and width coverage of the respective actuator membranes with the respective piezo-electric parts may be combined, such that a total surface coverage of the actuator membranes with piezo-electric parts may be between 35% and 100%, preferably between 50% and 98%, more preferably between 70% and 95%.

In an embodiment, the first actuator membrane and the second actuator membrane may have substantially the same length and width. Preferably the surface coverage of the first actuator membrane with the first piezo-electric part and of the second actuator membrane with the second piezo-electric part are substantially the same.

In an embodiment, the actuator membranes may be made of a material selected from the group consisting of silicon (Si), silicon nitride (SiN), silicon rich nitride (SiRN), titanium nitride, aluminum nitride, boron nitride, zirconium nitride, zirconium oxide, titanium oxide, aluminum oxide, silicon carbide, titanium carbide, tungsten carbide, tantalum carbide, and mixtures thereof.

In an embodiment, the piezo-electric parts comprise thin film piezo-electric parts, preferably made of PZT. The piezo-electric parts may be configured to expand and/or contract at least in the width direction of the respective actuator membranes upon actuation.

In an embodiment, the ink jet printing device is a MEMS based inkjet printing device.

During operation, ink jet printing devices may suffer from impaired drop formation, for example caused by (partially) clogged nozzles, presence of air and/or dirt in the pressure chamber, usually in the vicinity of the nozzles. Such artifacts may have a marked influence on the acoustics inside the pressure chamber and can be detected by using the piezo-electric actuator as a sensor. In a sensing mode, the piezo-electric actuator transforms the residual pressure response in the liquid (e.g. an ink composition) present in the pressure chamber into an electric signal. The generated electric signal typically reveals if the drop formation is impaired or not. In particular, the electric signal may reveal the type of artifact (clogging, air entrapment, presence of dirt, etc.), such that a required ink dot may be printed by a neighboring nozzle and/or that specific maintenance actions (e.g. purging, wiping, flushing, etc) can be performed. Conventional ink jet printing devices comprise, a single piezo-electric actuator per pressure chamber. In such a configuration, the piezo-electric actuator can either be used in an actuating mode (i.e. generating a pressure response in the liquid present in the pressure chamber) or in a sensing mode as described above, in a subsequent manner. Due to the application of an actuation pulse and subsequently measuring the residual pressure response with the piezo-electric actuator, the initial pressure response generated by the actuation pulse cannot be measured. Moreover, due to damping of the generated pressure response (leading to a decreased signal to noise ratio), the sensed residual pressure response may be less informative about the acoustic situation of the pressure chamber.

The ink jet printing device according to the present invention may be used in a method for monitoring the acoustic situation inside the interior of the ink jet printing device, in particular in the pressure chamber. In said method the first piezo-electric part may be used in an actuating mode and the second piezo-electric part may be used in a sensing mode, the method comprising the steps of:

1. actuating the first piezo-electric part such that a pressure response is induced in the pressure chamber via the first actuator membrane;
2. measuring the pressure response by the second piezo-electric part via the second actuator membrane;

characterized in that steps 1 and 2 are performed simultaneously.

The fact that the first and the second actuator membranes are mechanically decoupled prevents (or at least mitigates) that the sensing piezo-electric part directly measures the actuation movement of the actuated piezo-electric part. Instead the acoustic situation of the pressure chamber may be determined during and after the application of an actuation pulse.

It is an advantage of the present embodiment that by simultaneously actuating (with the first piezo-electric part) and sensing (by the second piezo electric part), sensing of the pressure response immediately starts when an actuation pulse is applied. The sensed signal is not limited to the residual pressure response, but also contains the initial pressure response generated during the application of the actuation pulse. The initial pressure response has been damped to a lesser extent, such that its signal to noise ratio will be higher than the signal to noise ratio of the residual pressure response. Therefore the sensed signal may be more informative about the acoustic situation of the pressure chamber, in particular concerning the presence of artifacts and the type(s) thereof.

In an embodiment, the method further comprises the steps of:

3. comparing the measured pressure response with predetermined pressure responses corresponding to several types of artifacts;
4. determining if an artifact is present and if so determining the type of the artifact.

In the present embodiment the measured pressure response, represented by an electric signal generated by the second piezo-electric part, may be compared with predetermined pressure responses corresponding to several types of artifacts, for example as described above. The predetermined pressure responses may be stored in a database.

In an embodiment characteristics of pressure responses associated with the several types of artifacts may be predetermined and (additionally) stored in a database (e.g. (initial) amplitude, period, speed of damping, frequency spectrum etc.)

The method according to the present embodiment comprises the steps of:

1. actuating the first piezo-electric part such that a pressure response is induced in the pressure chamber via the first actuator membrane;
2. measuring the pressure response by the second piezo-electric part via the second actuator membrane;
3. determining a characteristic of the pressure response measured in step 2 and comparing the characteristic with similar characteristics of predetermined pressure responses associated with the several types of artifacts;
4. determining if an artifact is present and if so determining the type of the artifact;

wherein steps 1 and 2 are performed simultaneously.

In the present embodiment at least one characteristic of the measured pressure response, e.g. the initial amplitude, is compared to the same characteristic (in the example the initial amplitude) of predetermined pressure responses associated with the several artifacts, e.g. clogging, air entrapment or the presence of dirt (step 3). An artifact may be identified if the characteristic of the measured pressure response (step 2) corresponds (within a certain predetermined margin) to same characteristic of the predetermined pressure response associated with that artifact. In order to provide distinctiveness among different types of artifacts, the used characteristic preferably has a unique value for each type of artifact In an embodiment more than one characteristic of the pressure response may be determined and compared with similar characteristics of predetermined pressure responses associated with the several types of artifacts.

In the present embodiment the distinctiveness among the different types of artifacts may be improved by combining more than one characteristic to identify a certain artifact.

The characteristics may for example be selected from the group consisting of initial amplitude, amplitude, period, speed of damping (damping factor) and frequency spectrum.

In an embodiment, the second step comprises measuring a first pressure response by the second piezo-electric part via the second actuator membrane starting simultaneously with the actuation of the first piezo-electric part (step 1) and measuring a second pressure response by the first piezo-electric part starting after the actuation of the first piezo-electric part (step 1).

The first pressure response corresponds to the pressure response described above and may be delayed (time-shifted) with respect to the second pressure response due to transfer inertia of the pressure response from the first actuator membrane to the second actuator membrane. Said delay (time-shift) may provide additional information about the acoustic situation of the pressure chamber, i.e. the delay (time-shift) may be used as an additional characteristic for identifying artifacts.

In an embodiment an actuation pulse is used in step 1 that does not generate a droplet.

If an artifact is detected and the type thereof is identified in step 4 of any of the methods described in the above embodiments, printing may be continued if it is known that the type of artifact may be resolved by some idle time of the respective nozzle, for example when the artifact comprises air in the nozzle or in the pressure chamber. During the idle time, the artifact may disappear spontaneously, after which printing with the respective nozzle can be continued. During the idle time, required dots may be printed with another nozzle, for example a neighboring nozzle. If however the type of artifact is more serious, such as dirt in the nozzle or in the pressure chamber, it may be necessary to stop printing and go to a service mode in which one or more maintenance actions (e.g. purging, wiping, flushing, a combination of the plural, etc) have to be performed (off-line) in order to get rid of the dirt, because this will not happen spontaneously.

Therefore, in an embodiment the method comprises the steps of:

1. actuating the first piezo-electric part such that a pressure response is induced in the pressure chamber via the first actuator membrane;
2. measuring the pressure response by the second piezo-electric part via the second actuator membrane;

wherein steps 1 and 2 are performed simultaneously and wherein the method further comprises the steps of:

3. comparing the measured pressure response with predetermined pressure responses corresponding to several types of artifacts and/or determining a characteristic of the pressure response measured in step 2 and comparing the characteristic with similar characteristics of predetermined pressure responses associated with the several types of artifacts;
4. determining if an artifact is present and if so determining the type of the artifact;

wherein steps 1-4 are performed for a first pressure chamber associated with a first nozzle orifice, and wherein the method further comprises the step of:

5. printing a dot using a second pressure chamber associated with a second nozzle orifice and/or selecting a maintenance action to be applied to the first pressure chamber associated with the first nozzle orifice based on the determined type of artifact present in the first pressure chamber and/or the first nozzle orifice, with the proviso that step 5 is omitted when no artifact is present in the first pressure chamber and/or the first nozzle orifice.

For the above described method it may be advantageous that the ink jet printing device comprises:

a pressure chamber;

a first actuator membrane being arranged to form a first flexible wall of a first part of the pressure chamber;

a first piezo-electric part being operatively connected to a surface of the first actuator membrane and being operable in an actuating mode and a sensing mode;

a second actuator membrane being arranged to form a second flexible wall of a second part of the pressure chamber;

a second piezo-electric part being operatively connected to a surface of the second actuator membrane and being operable in an actuating mode and a sensing mode an orifice, the orifice extending from the pressure chamber to an outer surface of the printing device, the orifice being arranged at an interface between the first and the second part of the pressure chamber.

The term interface as used in the present embodiment, should be construed as an imaginary plane dividing the pressure chamber into the first and the second part, such that the first actuator membrane is arranged to form a first flexible wall of the first part of the pressure chamber and the second actuator membrane is arranged to form a second flexible wall of the second part of the pressure chamber. The first and the second parts of the pressure chamber are therefore not physically separated, i.e. the combined first and the second parts of the pressure chamber form one internal volume, substantially equal to the internal volume of the pressure chamber.

In this configuration, the (nozzle) orifice and its surrounding part of the pressure chamber, which are the most crucial parts of the ink jet printing device, are located between the first piezo-electric part and the second piezo-electric part. Hence, in a sensing mode wherein the first actuator membrane may be operated in the actuating mode and the second actuator membrane may be operated in a sensing mode (or vice versa), a pressure response generated by the first piezo-electric part via the first actuator membrane propagates through the most crucial parts of the ink jet printing device before being sensed by the second piezo-electric part associated with the second actuator membrane (or vice versa). Detection of artifacts in the nozzle and its surrounding part of the pressure chamber may therefore be improved.

In an embodiment, the ink jet printing device further comprises detection electronics operatively connected to the first piezo-electric part and the second piezo-electric part, such that in the sensing mode an electric signal generated by the first piezo-electric part and/or the second piezo-electric part can be detected.

The detection electronics may comprise devices for measuring an electric signal, for example a generated current of potential difference (voltage).

The ink jet printing device according to the present invention may also be used in a printing method, wherein droplet size modulation during printing may be required. The first actuator membrane may be used in a first actuating mode, wherein a first actuation pulse is applied to the first actuator membrane while the second actuator membrane is not actuated. A droplet having a first size may be generated. In a second actuating mode, the second actuator membrane may be actuated using a second actuating pulse, preferably different from the first actuating pulse while the first actuator is not actuated. A droplet having a second size may be generated. In a third actuating mode, the first actuator membrane may be actuated using a third actuating pulse, which may be the same or different from the first actuating pulse and the second actuator membrane may be actuated using a fourth actuating pulse, which may be the same or different from the second actuating pulse. A droplet having a third size may be generated.

In an embodiment, the first actuator membrane is always actuated with the same first actuating pulse and the second actuator membrane is always actuated with the same second actuating pulse, the second actuating pulse preferably being different from the first actuating pulse. In this embodiment three different (discrete) droplet sizes may be generated.

The actuator membrane may be prepared by using a wafer-size first carrier plate on which the piezo-electric parts are applied, for example by bonding or by deposition, dependent on the required thickness of the piezo-electric parts. An electrically conductive structure arranged for driving the piezo-electric parts may be formed according to a suitable pattern on the top surface of the carrier plate. The first carrier plate is preferably formed by an SOI wafer having a top silicon layer which will later form the actuator membrane, a bottom silicon layer that will later be etched away, and a silicon dioxide layer separating the two silicon layers and serving as an etch stop.

In a practical embodiment, the top silicon layer and hence the membrane may have a thickness between 0.1 μm and 25 μm, preferably between 0.5 and 10 μm, more preferably between 1 and 5 μm. The etch stop may have a thickness of between 0.1 and 2 μm and the bottom silicon layer may have a thickness of between 150 and 1000 μm, so that a high mechanical stability during print head assembly is assured.

If the required thickness of the piezo-electric parts is below 3 μm, a more economic manufacturing process may be applied: the piezo-electric parts may be deposited on the wafer-size carrier plate instead of being bonded thereto. The latter process may require the following process steps:

preparing the piezo-electric parts on a second carrier plate;

bonding the piezo-electric parts to the first carrier plate;

removing the second carrier plate.

These steps may be dispensed with, when the piezo-electric parts may be directly deposited onto the first carrier plate.

BRIEF DESCRIPTION OF THE DRAWINGS

These and further features and advantages of the present invention are explained hereinafter with reference to the accompanying drawings showing non-limiting embodiments and wherein.

DETAILED DESCRIPTION OF THE DRAWINGS

Figure 1A:
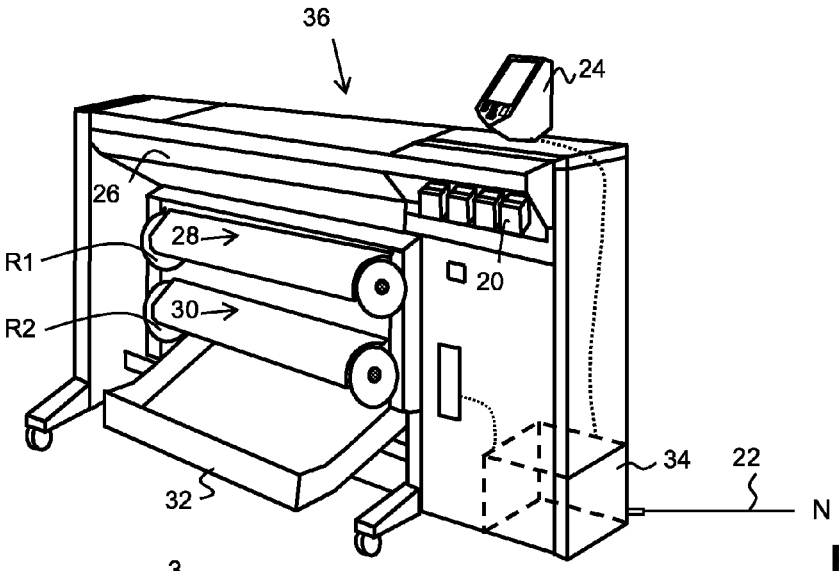
FIG. 1A shows a perspective view of an image forming apparatus applying an inkjet print head for providing an image on an image receiving member.

The present invention will now be described with reference to the accompanying drawings, wherein the same reference numerals have been used to identify the same or similar elements throughout the several views.

Figure 1B:
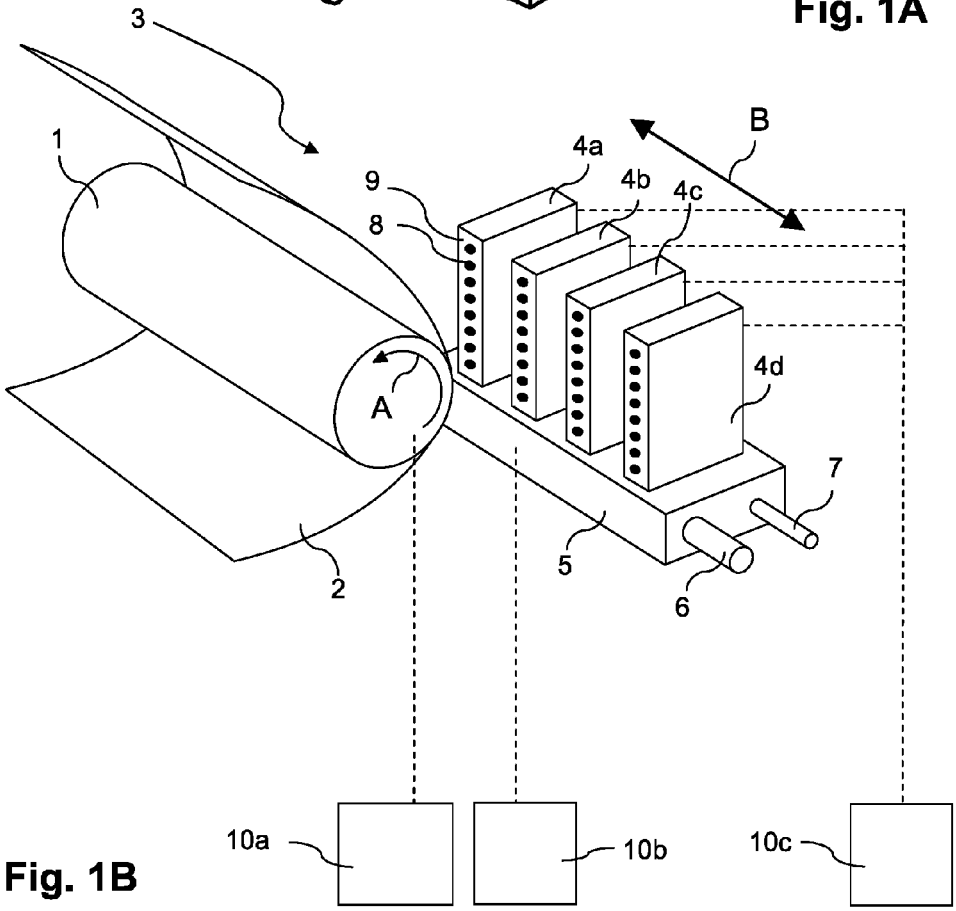
FIG. 1B shows a perspective view of a schematical representation of an embodiment of an inkjet process.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2:
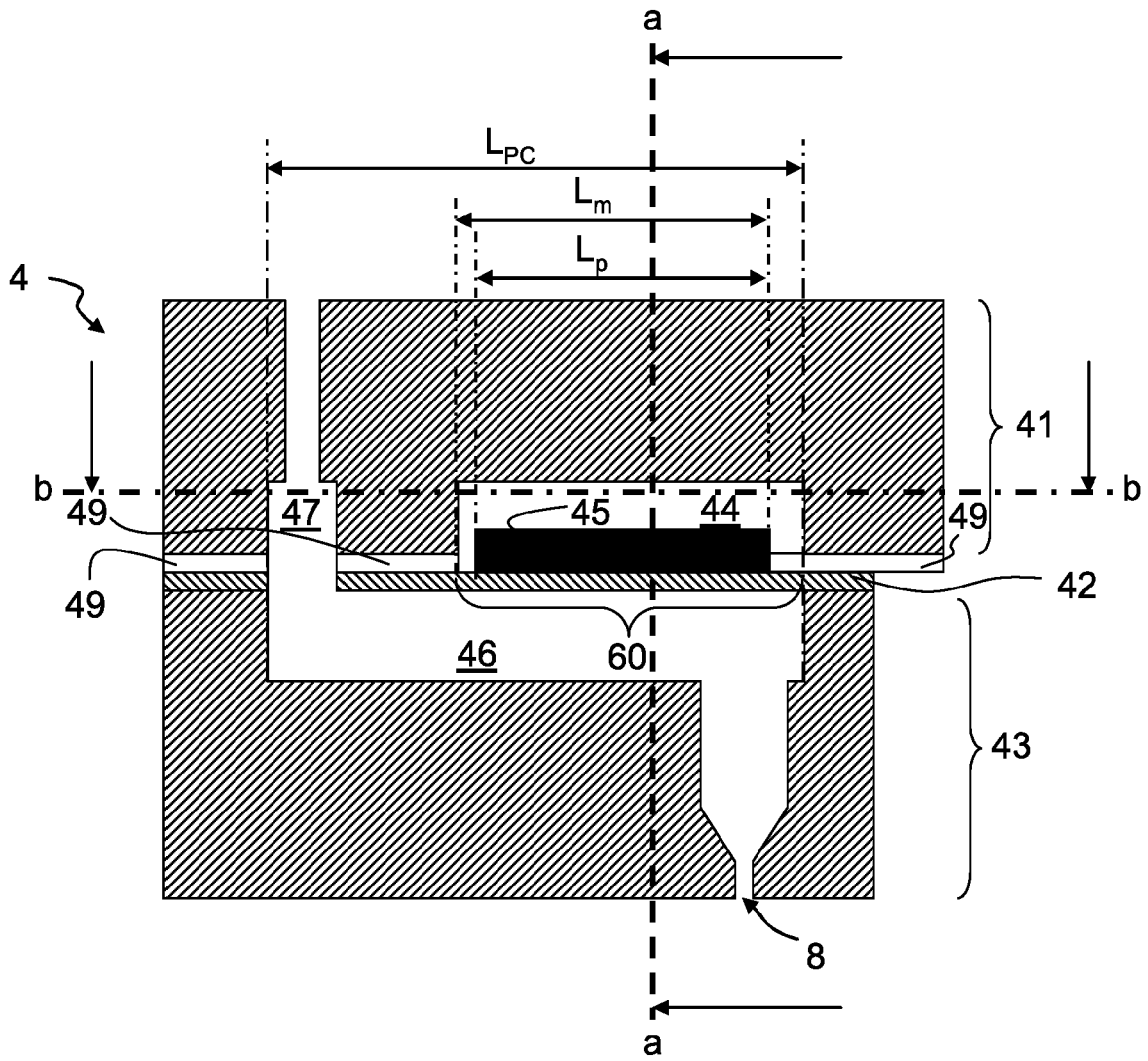
FIG. 2 shows a schematical cross-section of an embodiment of an inkjet print head.

FIG. 2 shows an embodiment of a print head 4 in more detail. The print head 4 is assembled from three layers of material: a first layer 41 having arranged therein a fluid inlet channel 47 and an actuator cavity 44; a second layer 42 having arranged thereon a piezo actuator 45 and provided with a through hole to extend the inlet channel 47; and a third layer 43 having arranged therein a pressure chamber 46 and a corresponding orifice 8 (also referred to as nozzle). FIG. 2 shows a bonding layer 49, which provides bonding of the first layer 41 and the second layer 42. Similarly the second layer 42 and the third layer 43 may be bonded to each other (not shown).

The print head 4 is configured to receive a fluid such as an ink composition through the inlet channel 47. The fluid fills the pressure chamber 46. Upon supply of a suitable drive signal to the piezo actuator 45, a pressure response is generated in the pressure chamber 46 resulting in a droplet of fluid being expelled through the nozzle 8.

Figure 3:
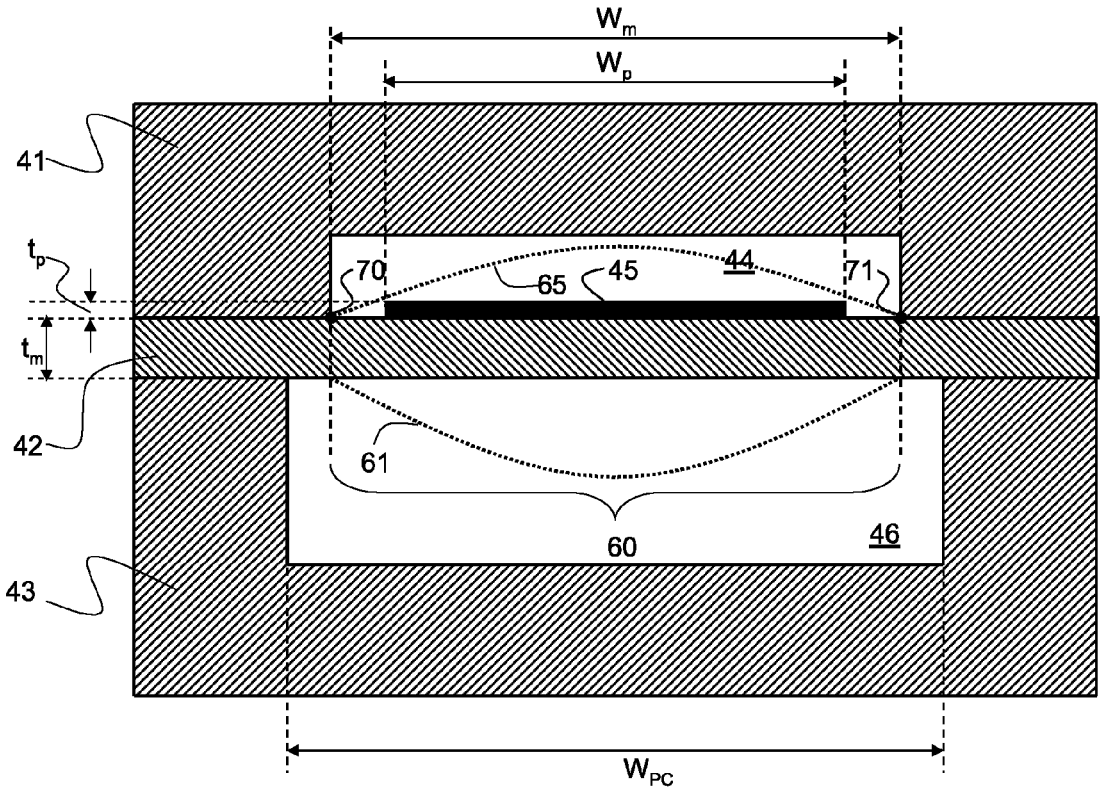
FIG. 3 schematically shows a cross sectional view (a-a) of the ink-jet printing device of FIG. 2, with a conventional actuator membrane arrangement.

FIG. 3 shows a cross sectional view of a print head 4 along line a-a as shown in FIG. 2 and comprising a conventional actuator arrangement. The second layer 42 has a thickness of $t_{m,1}$. In principle, the actuator membrane 60 is defined as a part of the second layer 42 being clamped between two fixing lines, which are in the cross sectional representation of FIG. 3 indicated with points 70 and 71 respectively. The bonding layer between the first layer 41 and the second layer 42, which is indicated with 49 in FIG. 2, is not shown in FIG. 3. The presence of such a bonding layer would render the effective membrane width somewhere between $W_m$ and $W_{PC}$, hence the distance between the two fixing lines may vary between $W_m$ and $W_{PC}$, dependent on the properties of the bonding layer 49. The actuator membrane has a width $W_m$, a length $L_m$ (see FIG. 2), and a thickness $t_m$ the width of the actuator membrane being smaller than the length of the actuator membrane, such that the aspect ratio, $AR=L_m/W_m$ is larger than 1. The thickness of the piezo-actuator 45 (in the context of the present invention also referred to as the piezo-electric part) is $t_p$. The coupling efficiency between electrical energy and energy related to mechanical bimorph operation of the actuator membrane depends on the ratio of $t_p$ and $t_m$. The optimum value of this ratio depends on material properties of the actuator membrane and the piezo-electric material and is approximately 1 for a silicon membrane and PZT piezo-electric material. The piezo-electric part 45 is arranged in an actuator cavity 44. Upon actuation by applying a suitable driving signal to the piezo-electric part, the piezo-electric part first expands in at least its width direction. At the interface of the piezo-electric part 45 and the first membrane 60 (see also FIG. 2) the piezo-electric part 45 is rigidly fixed to the surface of the actuator membrane 60, for example by an adhesive layer. The expansion of the piezo-electric part 45 is therefore restricted at said interface. The surface of the piezo-electric part 45 opposite to the interface of the piezo-electric part 45 and the membrane is a free surface. The expansion of the piezo-electric part 45 is therefore not restricted, or at least to a lesser extent. The actuator membrane is deformed by bimorph operation, as schematically indicated by dotted line 65. During this deformation the pressure chamber fills with ink. In a second part of the actuation, the piezo-electric part contracts at least in its width direction by applying a suitable driving signal. The contraction of the piezo-electric part 45 is again restricted at the above described interface. The contraction of the piezo-electric part 45 at the above mentioned free surface is not restricted, or at least to a lesser extent. In the second part of the actuation, the actuator membrane is deformed by a bimorph operation, as schematically indicated by dotted line 61. A pressure response is generated in the marking fluid, e.g. an ink composition, present in the pressure chamber 46. This pressure response may result in a droplet of marking fluid, e.g. an ink composition, to be expelled through nozzle 8 (see FIG. 2).

Figure 4:
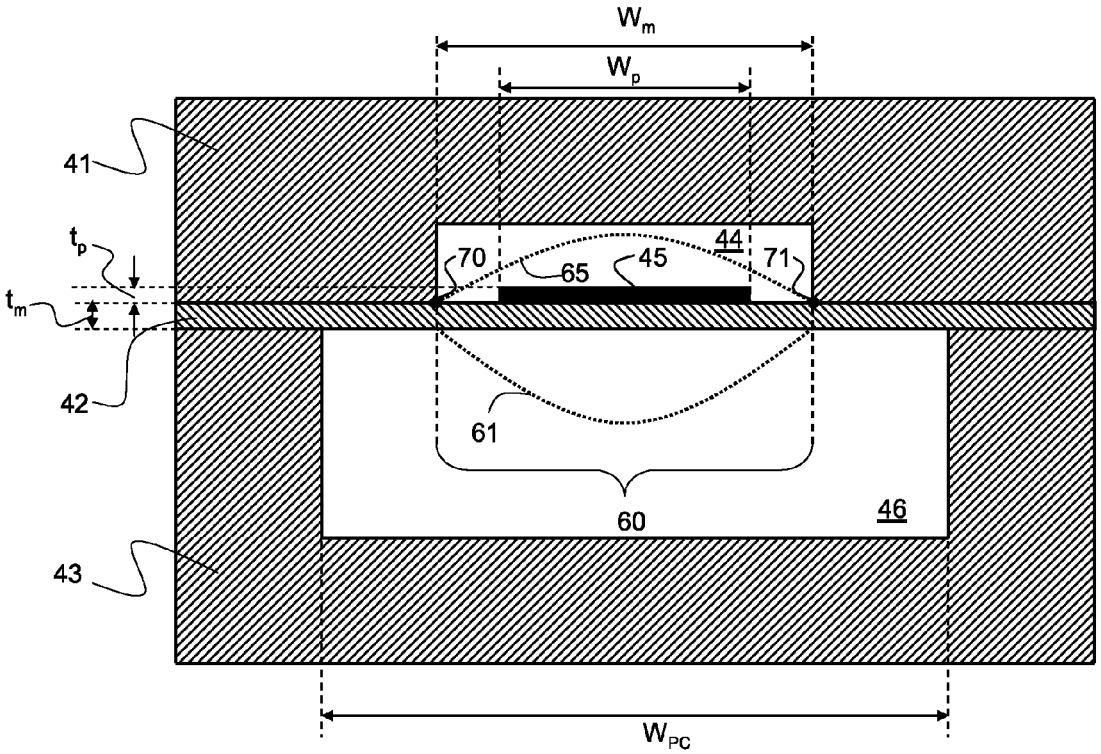
FIG. 4 schematically shows a cross sectional view (a-a) of the ink-jet printing device of FIG. 2, with an actuator membrane arrangement known from the prior art.

FIG. 4 shows a cross sectional view of a print head 4 along line a-a as shown in FIG. 2 and comprising an actuator arrangement known from the prior art. With respect to the previously described embodiment (FIG. 3), the thickness of the second layer 42, $t_m$, has been reduced. In order to maintain a similar compliance of the actuator membrane as shown in FIG. 3, the width of the actuator membrane $W_m$ has been reduced by reducing the distance between the two fixing lines, which are in the cross sectional representation of FIG. 4 indicated with points 70 and 71. Consequently, the width of the piezo-electric part $W_p$ has been reduced as well. Upon actuation, the actuator membrane is deformed by a bimorph operation as described above and schematically indicated by dotted lines 61 and 65. If the length of the actuator membrane $L_m$ (see FIG. 2 and FIG. 5) remains the same as in the previously described embodiment (see FIG. 3), the aspect ratio of the actuator membrane ($AR=L_m/W_m$) increases and the surface area of the actuator membrane (i.e. $L_m \times W_m$) decreases. In comparison to the embodiment as shown in FIG. 3, the driving voltage required to obtain a sufficiently large total volume displacement upon actuation of the actuator membrane according to the current embodiment is lower, because of the higher coupling efficiency. However, the driving voltage may even be further decreased by increasing the surface area of the actuator membrane, because this would increase the electric capacitance of the piezo-electric part 45. In order to maintain the compliance of the actuator membrane the surface area of the actuator membrane should be increased in combination with an increase of the aspect ratio of the actuator membrane. In other words: the membrane width should be further decreased and the membrane length should be increased, such that the total surface area of the membrane increases, the aspect ratio increases and the compliance of the actuator membrane remains constant.

By increasing the length of the actuator membrane and hence the length of the pressure chamber 46, $L_{PC}$ (see FIG. 2), the efficiency of generating the required pressure response and flow profile upon actuation may decrease, as explained earlier.

In popular terms, the ink flow filling the pressure chamber 46 cannot keep up with the actuation frequency.

Figure 5:
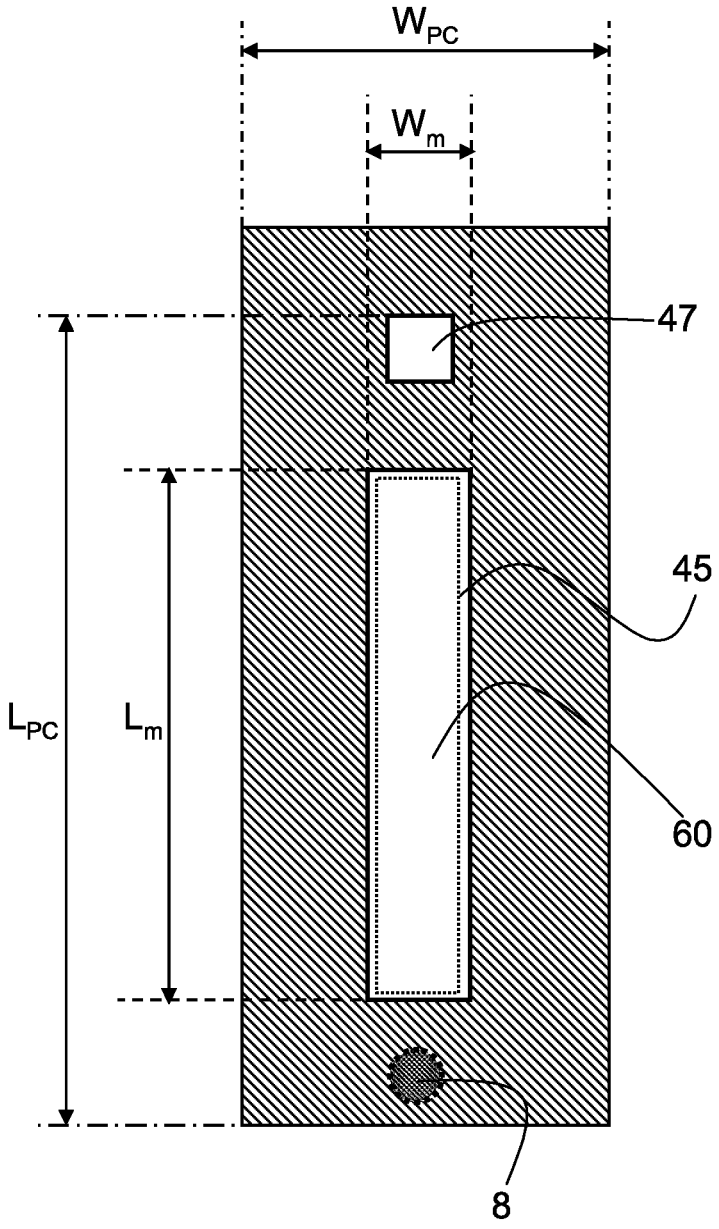
FIG. 5 schematically shows a cross sectional view (b-b) of the ink-jet printing device of FIG. 2, with an actuator membrane arrangement as shown in FIG. 4

FIG. 5 shows a cross sectional view (b-b) of the ink-jet printing device of FIG. 2, with an actuator membrane arrangement as shown in FIG. 4. FIG. 5 shows the pressure chamber 46 having a width $W_p$ and a length $L_{PC}$. For clarity reasons, the position of the piezo-electric part 45 has been indicated with a dotted line and the indications for the dimensions of the piezo-electric part are not shown in FIG. 5. A projection of the position of the orifice 8 (nozzle) and the position of the inlet channel 47 are also shown in FIG. 5. In this arrangement, the inlet channel 47 and the orifice 8 are arranged at opposite ends in the length direction of the pressure chamber 46.

Figure 6:
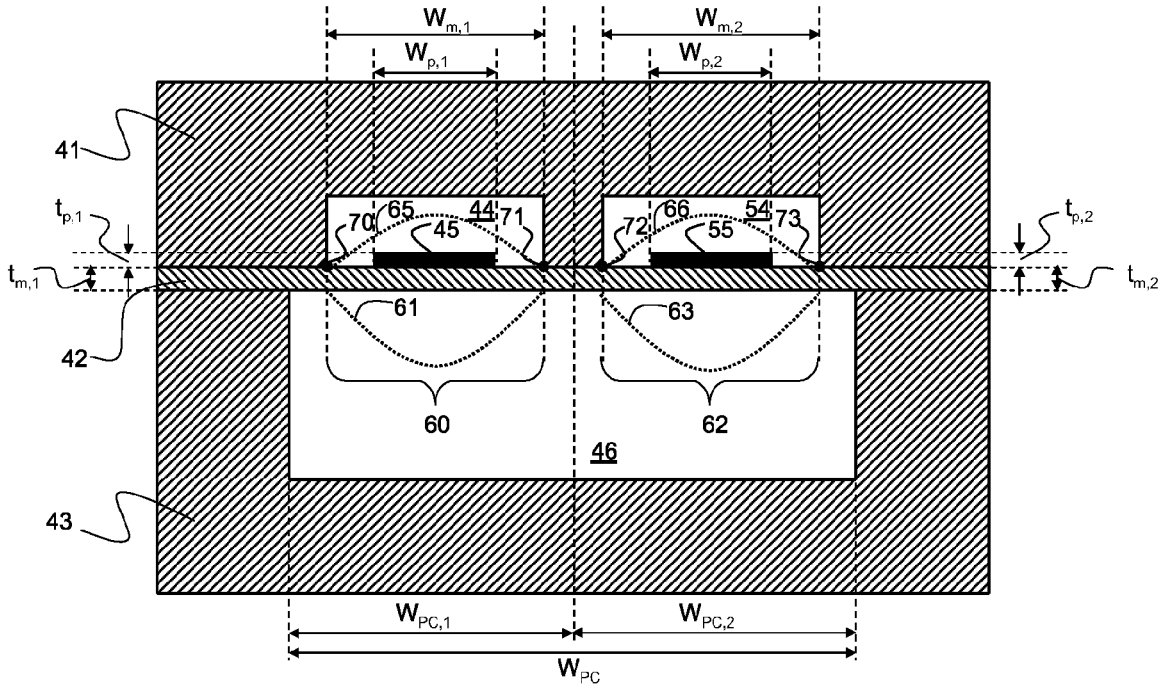
FIG. 6 schematically shows a cross sectional view (a-a) of the ink-jet printing device of FIG. 2, with an actuator membrane arrangement according to an embodiment of the present invention.

FIG. 6 shows a cross sectional view of an embodiment of the present invention and shows a print head 4 along line a-a as shown in FIG. 2. Instead of increasing the length of the actuator membrane $L_m$ (and also the length of the piezo-electric part $L_p$, the pressure chamber 46 is provided with a first actuator membrane 60 and a first piezo-electric part arranged in a first actuator cavity 44 and a second actuator membrane 62 with a second piezo-electric 55 part arranged in a second actuator cavity 54. The first actuator membrane has a first membrane length $L_{m,1}$ and a first membrane width $W_{m,2}$. The first actuator membrane 60 is defined as a part of the second layer 42 being clamped between two fixing lines, which are in the cross sectional representation of FIG. 6 indicated with points 70 and 71 respectively. The second actuator membrane 62 is defined as a part of the second layer 42 being clamped between two fixing lines, which are in the cross sectional representation of FIG. 6 indicated with points 72 and 73 respectively. The second actuator membrane has a width $W_{m,2}$ and a length $L_{m,2}$ (see FIG. 7), the width of the second actuator membrane being smaller than the length of the second actuator membrane. The thickness of the second actuator membrane is $t_{m,2}$, which in this particular embodiment is equal to the thickness of the second layer 42 and therefore equal to $t_{m,1}$. However, $t_{m,1}$ and $t_{m,2}$ may also be different. The thickness of piezo-actuator 55 (in the context of the present invention also referred to as the second piezo-electric part 55) is $t_{p,2}$ and may be the same as or different from $t_{p,1}$. Upon simultaneously actuating the first and the second actuator membranes the actuator membranes are simultaneously deformed by a bimorph operation, in a first step as schematically indicated by dotted lines 65 and 66 and in a second step as schematically indicated by dotted lines 61 and 63. This embodiment offers the ability to enlarge the ratio between the total membrane surface area (i.e. $L_{m,1} \times W_{m,1} + L_{m,2} \times W_{m,2}$) and the thicknesses of the actuator membranes ($t_{m,1}$, $t_{m,2}$), while keeping the compliance constant and without the introduction of run-time effects in the acoustics of long channels. The first actuator membrane 60 and the second actuator membrane 62 may also be actuated separately.

The presence of a bonding layer between the first layer 41 and the second layer 42, which is indicated with 49 in FIG. 2 and not shown in FIG. 6, would render the effective membrane width of the first actuator membrane 60 somewhere between $W_{m,1}$ and $W_{PC,1}$, and the effective membrane width of the second actuator membrane 62 somewhere between $W_{m,2}$ and $W_{PC,2}$, wherein $W_{PC,1}+W_{PC,2}=W_{PC}$. Hence the distance between the two fixing lines of the first actuator membrane (indicated with points 70 and 71 in FIG. 6) and the distance between the two fixing lines of the second actuator membrane (indicated with points 72 and 73 in FIG. 6) may vary between $W_{m,1}$ and $W_{PC,1}$ and $W_{m,2}$ and $W_{PC,2}$, respectively, dependent on the properties of the bonding layer 49. In some cases the fixing line of the first actuator membrane indicated with point 71 in FIG. 6 and the fixing line of the second actuator membrane indicated with point 72 in FIG. 6 may substantially coincide, such that the inactive membrane surface area is minimized.

Figure 7:
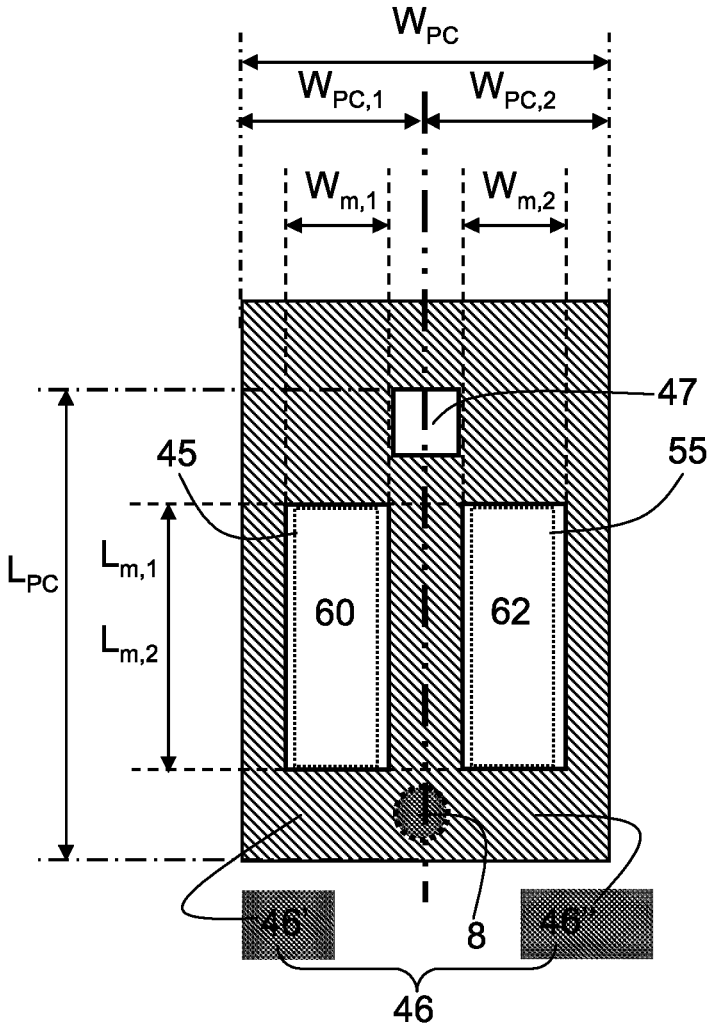
FIG. 7 schematically shows a cross sectional view (b-b) of the ink-jet printing device of FIG. 2, with an actuator membrane arrangement as shown in FIG. 6

FIG. 7 shows a cross sectional view (b-b) of the ink-jet printing device of FIG. 2, with an actuator membrane arrangement according to an embodiment of the present invention as shown in FIG. 6. FIG. 7 shows that the first actuator membrane 60 is arranged to form a flexible wall of a first part of the pressure chamber 46' and that the second actuator membrane 62 is arranged to form a flexible wall of a second part of the pressure chamber 46". The entire pressure chamber 46 has a width $W_{PC}$ and a length $L_{PC}$. For clarity reasons, the position of the piezo-electric parts 45 and 55 have been indicated with dotted lines and the indications for the dimensions of the piezo-electric parts are not shown in FIG. 7. A projection of the position of the orifice 8 (nozzle) is also shown in FIG. 7. The orifice 8 is arranged at an interface of the first and the second parts of the pressure chamber. In this embodiment, the actuator membranes 60 and 62 are arranged adjacent to each other in the width direction ($W_{PC}$) of the pressure chamber 46. The inlet channel 47 and the orifice 8 are arranged at opposite ends in the length direction of the chamber 46. In this embodiment, the length of the pressure chamber $L_{PC}$ may be reduced with respect to the length of the pressure chamber with a relatively long actuator membrane, as shown in FIG. 5. The present embodiment has an acoustic advantage (e.g. less disturbance caused by run-time effects) over a conventional arrangement as for example shown in FIG. 5.

Figure 8:
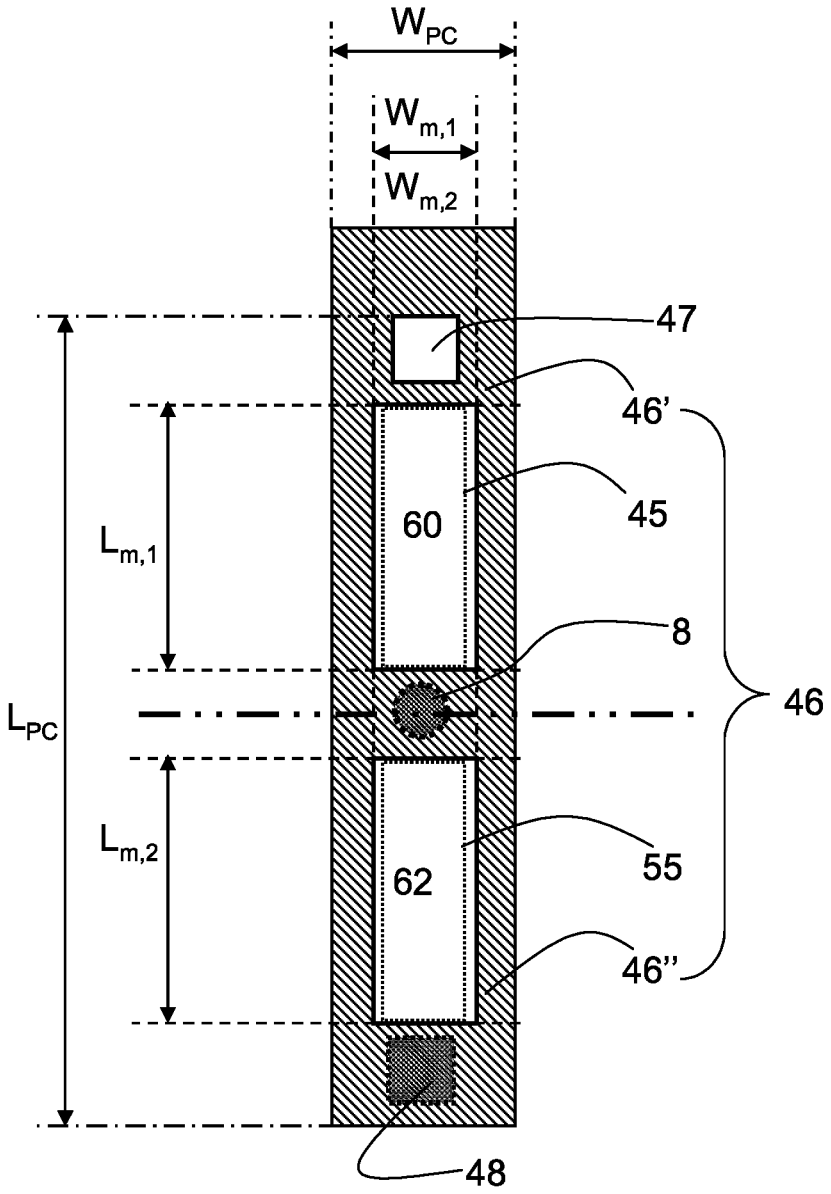
FIG. 8 schematically shows a cross sectional view (b-b) of the ink-jet printing device of FIG. 2, with an actuator membrane arrangement according to an embodiment of the present invention.

FIG. 8 shows a cross sectional view (b-b) of the ink-jet printing device of FIG. 2, with an actuator membrane arrangement according to an embodiment of the present invention. According to this embodiment, the first actuator membrane 60 is arranged to form a flexible wall of a first part of the pressure chamber 46' and that the second actuator membrane 62 is arranged to form a flexible wall of a second part of the pressure chamber 46" and the actuator membranes 60 and 62 are arranged adjacent to each other in the length ($L_{PC}$) direction of the pressure chamber 46.

The orifice 8 is arranged at an interface of the first and the second parts of the pressure chamber. In this embodiment, the first actuator membrane 60 is arranged up-stream the orifice 8 and the second actuator membrane 62 is arranged down-stream the orifice 8. The present embodiment has an acoustic advantage (e.g. less disturbance caused by run-time effects) over a conventional arrangement as for example shown in FIG. 5, because of the position of the orifice 8.

In this embodiment at least a part of the second part of the pressure chamber (46") may comprise a dead volume of fluid (i.e. a volume of non moving fluid), because the end of the pressure chamber 46, indicated with 50 is a dead end.

In a further embodiment, the printing device comprises an outlet channel 48, arranged in fluid connection with the second part of the pressure chamber (46") to remove fluid out of the second part of the pressure chamber (46"). The inlet channel 47 and the outlet channel in this embodiment are arranged at opposite ends in the length direction of the pressure chamber 46.

In operation, a fluid may be circulated through the pressure chamber 46 (flow-through arrangement), even when no droplet formation (actuation) occurs. The fluid may enter the pressure chamber via the inlet channel 47 and leave the pressure chamber via outlet channel 48. An advantage of this arrangement according to this embodiment is that the dead volume in the pressure chamber is minimized or even absent.

Figure 9:
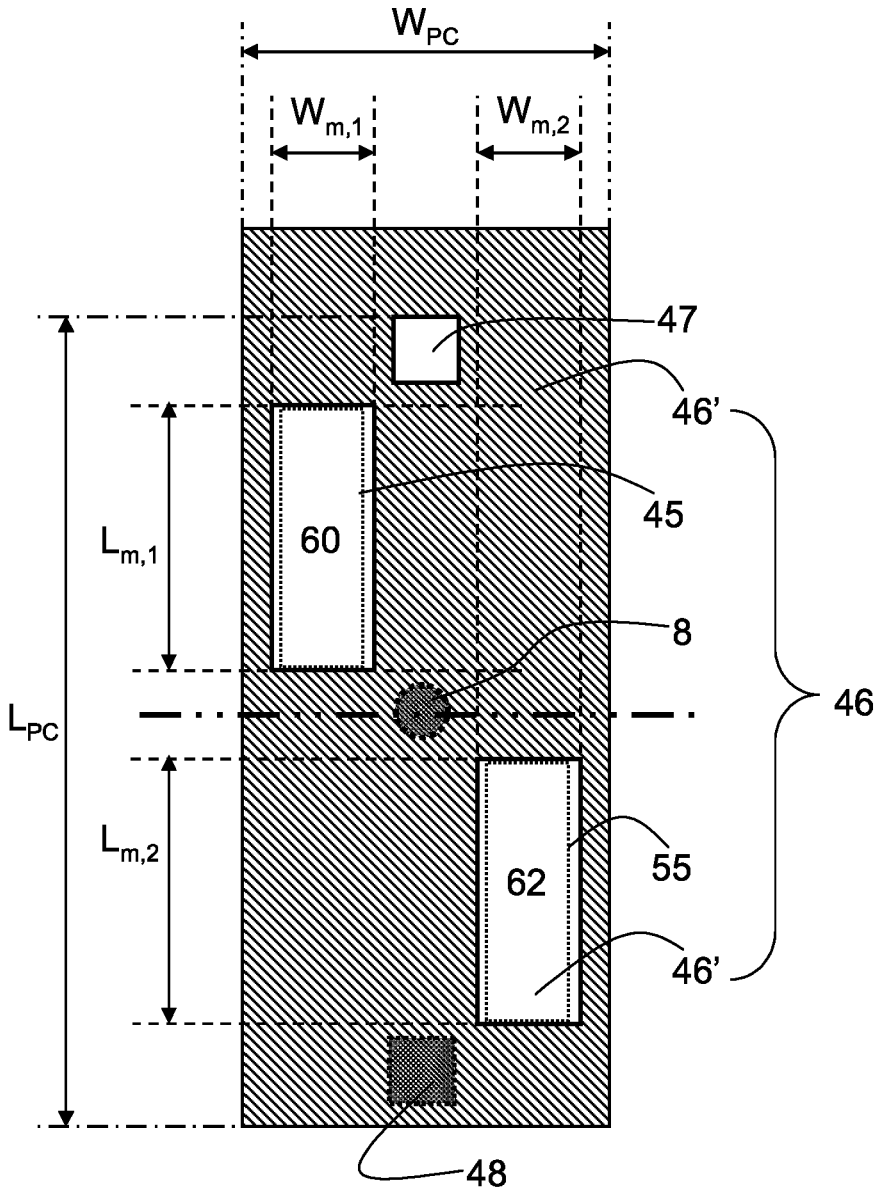
FIG. 9 schematically shows a cross sectional view (b-b) of the ink-jet printing device of FIG. 2, with an actuator membrane arrangement according to an embodiment of the present invention.

FIG. 9 shows a cross sectional view (b-b) of the ink-jet printing device of FIG. 2, with an actuator membrane arrangement according to an embodiment of the present invention. This embodiment is a variant (of many) of the embodiment shown in FIG. 8 and described above.

Table 1 shows a number of actuator membrane configurations having similar compliance.

TABLE 1 examples of actuator membrane configurations according to the present invention and their driving voltages (simulations)

| entry | Number of actuator membranes (n) | $L_m$ ($L_{m,1}$; $L_{m,2}$) [μm] | $W_m$ ($W_{m,1}$; $W_{m,2}$) [μm] | Total active surface area ($n \times W_m \times L_m$) [$\mu m^2$] | AR ($AR_1$; $AR_2$) [—] | $t_m$ ($t_{m,1}$; $t_{m,2}$) [μm] | Driving voltage [V] |
|---|---|---|---|---|---|---|---|
| 1 | 1 | 500 | 180 | 90000 | 2.78 | 5 | 30 |
| 2 | 1 | 500 | 115 | 57500 | 4.35 | 2 | 24 |
| 3 | 1 | 1000 | 100 | 100000 | 10 | 2 | 22 |
| 4 | 2 | 500 | 100 | 100000 | 5 | 2 | 19 |

Table 1 shows that the driving voltage can be reduced, while maintaining the compliance of the actuator membranes the same (compare entries 1 (FIG. 3) and 2 (FIG. 4)). It also shows that by further increasing the total active surface area and the aspect ratio, the driving voltage may be further reduced (compare entries 2 and 3 according to the embodiment as shown in FIG. 4). Table 1 also shows that a low driving voltage is even further reduced when two individually clamped actuators are used instead of one actuator having a high aspect ratio and thus a relatively large length (compare entries 3 and 4 according to the embodiments as shown in FIGS. 4 and 6, respectively).

The above shown embodiments are not limiting to the scope of the present inventions.

In other print head designs more than two individually clamped, i.e. mechanically decoupled, actuator membranes may result in an optimum in driving voltage and actuator performance in terms of e.g. coupling efficiency and/or volume displacement.

The illustrated print head 4 (FIGS. 2-9) may be manufactured from silicon, in particular lithographic methods and etching methods may be employed to form the first, second and third layers from silicon wafers. Thus, a compact and cost-efficient print head 4 may be manufactured. While the fluid to be expelled through the nozzle 8, such as an ink, flows through the inlet channel 47, the pressure chamber 46 and the nozzle 8, it is desirable to prevent that any fluid may arrive in the actuator cavity 44 and in the case of a multi-cavity first layer 41 as shown in FIG. 6 also in the actuator cavity 54 and thus reaching the piezo-electric parts 45 and 55 respectively, since the efficiency and thereby the lifetime of the piezo actuators is negatively influenced by fluid, moist, and the like. In order to prevent that the fluid reaches the piezo actuator, it is known to use an impermeable adhesive to bond the first layer 41 and the second layer 42. However, certain adhesives commonly used in silicon wafer processing such as BCB and the like may not be impermeable to the fluid (ink).

Figure 10A:
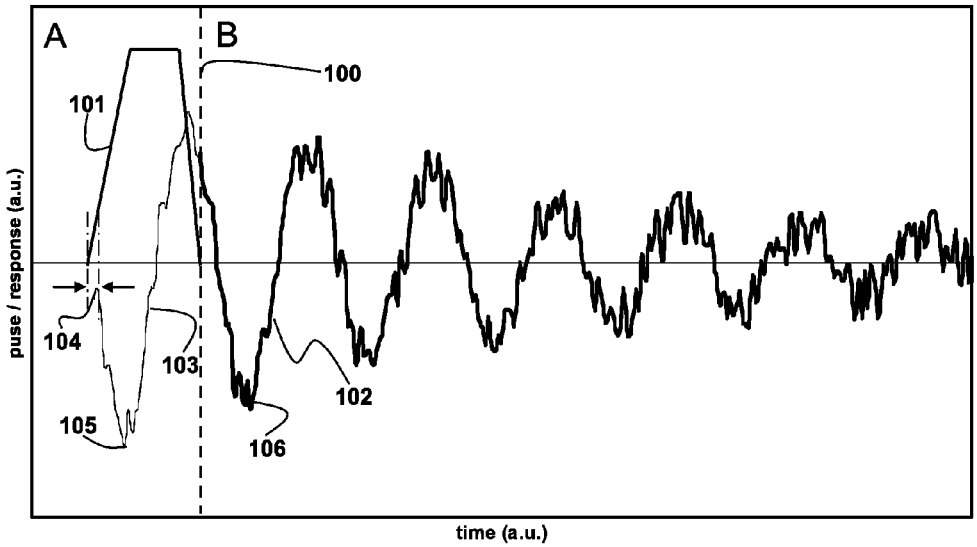
FIGS. 10A and 10B schematically shows an actuation pulse and a corresponding pressure response.
Figure 10B:
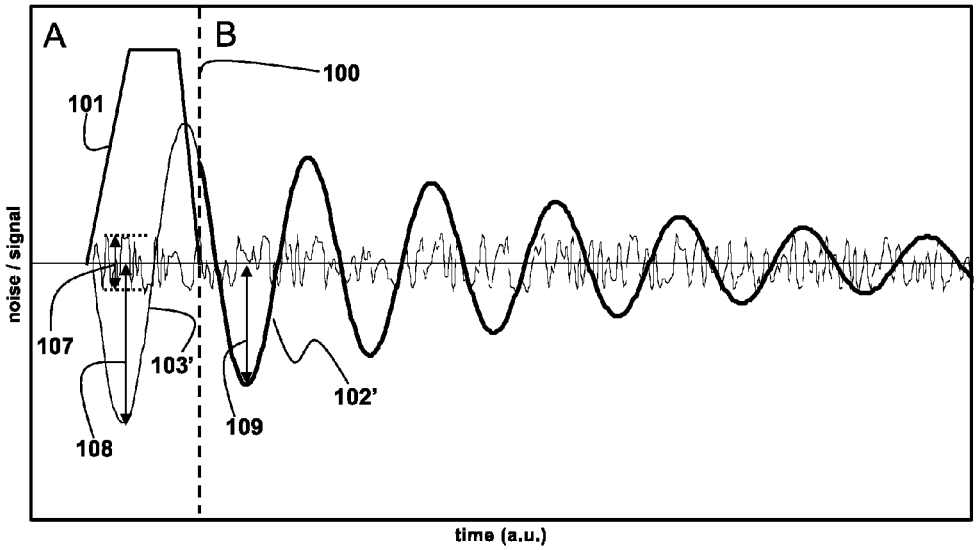

FIGS. 10A and 10B show an actuation pulse 101. FIG. 10A shows a corresponding pressure response. In a conventional actuator membrane arrangement comprising a single actuator membrane 60 (FIG. 3) and a single piezo-electric part 45 (FIG. 3), the actuator membrane can be successively used in an actuating mode (indicated by time period A in FIGS. 10A and 10B) and a sensing mode (indicated by time period B in FIGS. 10A and 10B). In FIGS. 10A and 10B an actuation period A comprising an actuation pulse 101 and a sensing period B are shown, which are separated by the end of actuation pulse 101, indicated with dashed line 100. However, the pressure response inside the pressure chamber immediately starts when the actuation pulse starts, as is indicated with curve 103.

In an embodiment of the present invention two actuator membranes (60 and 62 in FIGS. 6, 7, 8 and 9) are associated with a single pressure chamber (46 in FIG. 6). The first actuator membrane 60 (FIG. 6) comprising the first piezo-electric part 45 (FIG. 6) may be operated in the actuating mode and simultaneously the second actuator membrane 62 (FIG. 6) comprising the second piezo-electric part 55 (FIG. 6) may be operated in the sensing mode, or vice versa.

In this way, the actuation period is again represented by time period A in FIGS. 10A and 10B. The sensing period is however represented by the combined time periods A and B. In other words, the sensing of the acoustic situation of the pressure chamber starts simultaneously with the actuation period. Therefore, in this embodiment the sensed pressure response comprises both the pressure response inside the pressure chamber during the actuation pulse as indicated with curve 103 (also termed the initial pressure response) and the pressure response after the actuation pulse, curve 102 (also termed residual pressure response). The obtained pressure response signal may therefore be more informative concerning the acoustic situation inside the pressure chamber than if a single actuator membrane is successively operated in an actuating mode and a sensing mode, as described above.

Due to a small delay in the detection response of the second actuator membrane, which may exist due to transfer inertia of the pressure response to the second actuator membrane, the pressure response detected by the second actuator membrane may be slightly shifted in time (indicated with 104 in FIG. 10A). By applying the above described method, the detected pressure response comprises the pressure responses indicated with curve 102 and curve 103.

FIG. 10B shows that the sensed pressure response (102 and 103 in FIG. 10A) is a sum of a real pressure response, indicated with 102' and 103' and a noise signal. FIG. 10B shows that the signal to noise ratio of a first part of the signal corresponding to the initial pressure response (curve 103 in FIG. 10A) is larger than the signal to noise ratio of a second part of the signal corresponding to the residual pressure response (curve 102 in FIG. 10A).

The signal to noise ratio (SNR) may be defined by the following formula:

$$\mathrm{SNR}=A_{signal}^2/A_{noise}^2$$

Wherein:

SNR is the signal to noise ratio;

$A_{noise}$=the amplitude of the noise;

$A_{signal}$=the amplitude of the signal.

The units of the amplitudes of the noise and the signal are the same such that the SNR is a dimensionless number. In the present invention, the signal generated by the second piezo-electric upon detecting the pressure response generated by the first piezo-electric part may be an electric signal. The unit of the amplitude of the detected signal may for example be A (ampere) if the induced current is measured or V (Volt) if the induced potential difference (voltage) is measured.

Independent thereof, the following example can be given:

If the amplitude of the noise (two times the amplitude of the noise is indicated with 107) is approximately 15% of the amplitude of the signal corresponding to the initial pressure response (indicated with 108), the SNR is $1^2/0.15^2=44.4$. The amplitude of the signal corresponding to the residual pressure response (e.g. indicated with 109), which is damped by a factor of approximately 0.75 in the present example, is approximately 75% of the amplitude of signal corresponding to the initial pressure response (108). At the same (absolute) noise level, the SNR of the signal corresponding to the residual pressure response is $(0.75*1)^2/0.15^2=25$. The SNR will further decrease when the residual pressure response is further damped, which is shown in FIGS. 10A and 10B. The larger the signal to noise ratio is, the more informative the sensed pressure response may be concerning the acoustic situation of the pressure chamber.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term another, as used herein, is defined as at least a second or more. The term having, as used herein, is defined as comprising (i.e., open language). The term operatively connected, as used herein, is defined as co-operating which does not necessarily mean that operatively connected parts are directly connected.

The invention claimed is:

1. An ink jet printing device comprising:

a pressure chamber formed in a housing;

a first actuator membrane having a first membrane width $W_{m,1}$ and a first membrane length $L_{m,1}$ the first membrane width being equal to or smaller than the first membrane length, the first actuator membrane is arranged to form a first flexible wall of the pressure chamber;

a first piezo-electric part being operatively connected to a surface of the first actuator membrane;

a second actuator membrane having a second membrane width $W_{m,2}$ and a second membrane length $L_{m,2}$, the second membrane width being equal to or smaller than the second membrane length, the second actuator membrane is arranged to form a second flexible wall of the pressure chamber; and a second piezo-electric part being operatively connected to a surface of the second actuator membrane, wherein the second flexible wall is mechanically decoupled from the first flexible wall, and wherein the first piezo-electric part and second piezo-electric part are located in separate cavities formed in the housing.

2. The ink jet printing device according to claim 1, wherein:

the first actuator membrane has a first aspect ratio, $AR_1=L_{m,1}/W_{m,1}$;

the second actuator membrane has a second aspect ratio, $AR_2=L_{m,2}/W_{m,2}$; and wherein $AR_1$ and/or $AR_2$ is/are between 1 and 20.

3. The ink jet printing device according to claim 2, wherein:

the first actuator membrane has a first membrane thickness $t_{m,1}$;

the first piezo-electric part has a first piezo thickness $t_{p,1}$;

the second actuator membrane has a second membrane thickness $t_{m,2}$;

the second piezo-electric part has a second piezo thickness $t_{p,2}$;

and wherein $t_{p,1}/t_{m,1}$ and/or $t_{p,2}/t_{m,2}$ is/are between 0.1 and 2.

4. The ink jet printing device according to claim 2, wherein the first and the second actuator membranes are arranged such that their respective lengths ($L_{m,1}$ and $L_{m,2}$, respectively) are in parallel with the length of the pressure chamber, $L_{PC}$.

5. The ink jet printing device according to claim 2, wherein:

the first actuator membrane has a first surface arranged to form an inside surface of the first flexible wall of the pressure chamber and a second surface arranged opposite to the first surface and forming an outside surface of the first flexible wall of the pressure chamber, the first piezo-electric part being arranged on the second surface of the first actuator membrane;

the second actuator membrane has a third surface arranged to form an inside surface of the second flexible wall of the pressure chamber and a fourth surface arranged opposite to the first surface of the second actuator membrane and forming an outside surface of the second flexible wall of the pressure chamber, the second piezo-electric part being arranged on the fourth surface of the second actuator membrane.

6. The ink jet printing device according to claim 1, wherein:

the first actuator membrane has a first membrane thickness $t_{m,1}$;

the first piezo-electric part has a first piezo thickness $t_{p,1}$;

the second actuator membrane has a second membrane thickness $t_{m,2}$;

the second piezo-electric part has a second piezo thickness $t_{p,2}$; and wherein $t_{p,1}/t_{m,1}$, and/or $t_{p,2}/t_{m,2}$ is/are between 0.1 and 2.

7. The ink jet printing device according to claim 6, wherein $t_{m,1}$ and/or $t_{m,2}$ is/are between 0.1 μM and 10 μm, and wherein $t_{p,1}$ and/or $t_{p,2}$ is/are between 0.1 μm and 10 μm.

8. The ink jet printing device according to claim 7, wherein the first and the second actuator membranes are arranged such that their respective lengths ($L_{m,1}$ and $L_{m,2}$, respectively) are in parallel with the length of the pressure chamber, $L_{PC}$.

9. The ink jet printing device according to claim 6, wherein the first and the second actuator membranes are arranged such that their respective lengths ($L_{m,1}$ and $L_{m,2}$, respectively) are in parallel with the length of the pressure chamber, $L_{PC}$.

10. The ink jet printing device according to claim 6, wherein:

the first actuator membrane has a first surface arranged to form an inside surface of the first flexible wall of the pressure chamber and a second surface arranged opposite to the first surface and forming an outside surface of the first flexible wall of the pressure chamber, the first piezo-electric part being arranged on the second surface of the first actuator membrane;

the second actuator membrane has a third surface arranged to form an inside surface of the second flexible wall of the pressure chamber and a fourth surface arranged opposite to the first surface of the second actuator membrane and fanning an outside surface of the second flexible wall of the pressure chamber, the second piezo-electric part being arranged on the fourth surface of the second actuator membrane.

11. The ink jet printing device according to claim 1, wherein the first and the second actuator membranes are arranged such that their respective lengths ($L_{m,1}$ and $L_{m,2}$, respectively) are in parallel with the length of the pressure chamber, $L_{PC}$.

12. The ink jet printing device according to claim 11, wherein the first and the second actuator membranes are arranged adjacent to each other in the width direction of the pressure chamber.

13. The ink jet printing device according to claim 11, wherein the first actuator membrane is arranged to form a first flexible wall of a first part of the pressure chamber;

the second actuator membrane is arranged to form a second flexible wall of a second part of the pressure chamber;

the ink jet printing device comprises an orifice, the orifice extending from the pressure chamber to an outer surface of the printing device;

the orifice is arranged at an interface between the first and the second part of the pressure chamber.

14. The ink jet printing device according to claim 13, wherein the ink jet printing device further comprises:

an inlet channel being in fluid connection with the first part of the pressure chamber and arranged to supply a fluid to the pressure chamber;

an outlet channel being in fluid connection with the second part of the pressure chamber and arranged to remove the fluid out of the pressure chamber.

15. The ink jet printing device according to claim 1, wherein:

the first actuator membrane has a first surface arranged to form an inside surface of the first flexible wall of the pressure chamber and a second surface arranged opposite to the first surface and forming an outside surface of the first flexible wall of the pressure chamber, the first piezo-electric part being arranged on the second surface of the first actuator membrane;

the second actuator membrane has a third surface arranged to form an inside surface of the second flexible wall of the pressure chamber and a fourth surface arranged opposite to the first surface of the second actuator membrane and forming an outside surface of the second flexible wall of the pressure chamber, the second piezo-electric part being arranged on the fourth surface of the second actuator membrane.

16. The ink jet printing device according to claim 1, wherein:

the first piezo-electric part has a first piezo width $W_{p,1}$ and a first piezo length $L_{p,1}$, the first piezo width being equal to or smaller than the first piezo length;

the second piezo-electric part has a second piezo width $W_{p,2}$ and a second piezo length $L_{p,2}$, the second piezo width being equal to or smaller than the second piezo length;

and wherein $L_{p,1}/L_{m,1}$ and/or $L_{p,2}/L_{m,2}$ is/are between 0.7 and 1.

17. The ink jet printing device according to claim 1, wherein:

the first piezo-electric part has a first piezo width $W_{p,1}$ and a first piezo length $L_{p,1}$, the first piezo width being equal to or smaller than the first piezo length;

the second piezo-electric part has a second piezo width $W_{p,2}$ and a second piezo length $L_{p,2}$, the second piezo width being equal to or smaller than the second piezo length;

and wherein $W_{p,1}/W_{m,1}$ and/or $W_{p,2}/W_{m,2}$ is/are between 0.5 and 1.

18. The ink jet printing device according to claim 1, wherein the actuator membranes are made of a material selected from the group consisting of silicon (Si), silicon nitride (SiN), silicon rich nitride (SiRN), titanium nitride, aluminum nitride, boron nitride, zirconium nitride, zirconium oxide, titanium oxide, aluminum oxide, silicon carbide, titanium carbide, tungsten carbide, tantalum carbide, and mixtures thereof.

19. The ink jet printing device according to claim 1, wherein the piezo-electric parts comprise thin film piezo-electric parts.

20. The ink jet printing device according to 1, wherein the piezo-electric parts are made of PZT.

* * * * *